US008963443B2

(12) United States Patent
Choi et al.

(10) Patent No.: US 8,963,443 B2
(45) Date of Patent: Feb. 24, 2015

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Min-Soo Choi, Chungcheongnam-do (KR); Jin-Won Jang, Chungcheongnam-do (KR); Won-Sik Oh, Chungcheongnam-do (KR)

(73) Assignee: Samsung Display Co., Ltd. (KR)

( * ) Notice: Subject to any disclaimer, the term of this patent is extended or adjusted under 35 U.S.C. 154(b) by 764 days.

(21) Appl. No.: 13/219,322

(22) Filed: Aug. 26, 2011

(65) Prior Publication Data

US 2012/0062131 A1 Mar. 15, 2012

(30) Foreign Application Priority Data

Sep. 14, 2010 (KR) ..... 10-2010-0089739

(51) Int. Cl.
*H05B 37/02* (2006.01)
*H05B 33/08* (2006.01)

(52) U.S. Cl.
CPC ..... *H05B 33/0827* (2013.01)
USPC ..... 315/291; 315/308

(58) Field of Classification Search
CPC .... H05B 37/02; H05B 39/00; H05B 33/0827; H05B 33/083; H05B 33/0842; H05B 33/0884
USPC ..... 315/169.1–169.3, 185 R, 209 R, 291, 315/307, 308, 312
See application file for complete search history.

(56) References Cited

U.S. PATENT DOCUMENTS

| | | | | |
|---|---|---|---|---|
| 8,044,609 | B2 * | 10/2011 | Liu | 315/291 |
| 2006/0202637 | A1 | 9/2006 | Chiang | |
| 2007/0013620 | A1 | 1/2007 | Tanahashi et al. | |
| 2007/0069712 | A1 | 3/2007 | Kamatani | |
| 2008/0272651 | A1 | 11/2008 | Fong | |
| 2010/0026203 | A1 * | 2/2010 | Zhao et al. | 315/291 |
| 2010/0164403 | A1 | 7/2010 | Liu | |

FOREIGN PATENT DOCUMENTS

| | | |
|---|---|---|
| CN | 1941052 | 4/2007 |
| JP | 2003-332624 | 11/2003 |
| JP | 2006-319057 | 11/2006 |

OTHER PUBLICATIONS

European Search Report corresponding to EP 11178612.5, Jan. 16, 2012, 5 pages.

* cited by examiner

*Primary Examiner* — Jimmy Vu
(74) *Attorney, Agent, or Firm* — Innovation Counsel LLP

(57) ABSTRACT

A light source apparatus includes a plurality of light source parts, a power supply part, a current selection part and a current control part. The plurality of the light source parts are connected in parallel and the power supply part provides power to a first terminal of each of the light source parts. The current selection part selects the current level of one of the light source parts as a reference current level. The current control part adjusts the levels of the currents flowing through the light source parts to be substantially equal to the reference current level. Selection of the light source part that provides the reference current level is dynamically changed.

17 Claims, 6 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

PRIORITY STATEMENT

This application claims priority under 35 U.S.C. §119 to Korean Patent Application No. 10-2010-0089739 filed on Sep. 14, 2010 in the Korean Intellectual Property Office (KIPO), the contents of which are herein incorporated by reference in its entirety.

BACKGROUND OF THE INVENTION

1. Field of the Invention

The present invention relates to a method of driving a light source, a light source apparatus for performing the method and a display apparatus having the light source apparatus. More particularly, the present invention relates to a method of driving a light source capable of decreasing a current difference among light sources, a light source apparatus for performing the method and a display apparatus having the light source apparatus.

2. Description of the Related Art

Generally, liquid crystal display (LCD) devices have appealing characteristics such as thinness, light weight and power efficiency compared to other types of display devices. Thus, LCD devices are widely used to display images in various fields. An LCD device includes an LCD panel that displays an image using light transmissivity of liquid crystals and a backlight assembly disposed under the LCD panel to provide light to the LCD panel.

The LCD panel includes an array substrate having a plurality of thin-film transistors (TFTs) arranged in a matrix configuration, a color filter substrate facing the array substrate and a liquid crystal layer interposed between the array substrate and the color filter substrate.

The backlight assembly includes light sources that generate light for displaying images on the LCD panel. The light sources may be a cold cathode fluorescent lamp (CCFL), an external electrode fluorescent lamp (EEFL), a flat fluorescent lamp (FFL), a light-emitting diode (LED), etc.

The light sources are generally driven in parallel and about the same amount of current should flow through each of the light sources for a uniform distribution of luminance. However, varying degrees of voltage drop may occur due to slightly different characteristics of the light sources and the difference in the voltage drop may function as an impedance to the light sources connected in parallel. For this reason, the actual amount of current flowing through the light sources may not be equal. A current mirror circuit may be used to equalize the current levels among the light sources.

In the current mirror, a reference light source is fixed and the other light sources reproduce (or mirror) the current flowing through the reference light source. The total current is fed back based on the current flowing through the reference light source, so that the current mirror may operate only if the voltage drop of the reference light source is the highest.

For example, when the voltage drop of a light source other than the reference light source is the highest, a transistor of the current mirror circuit connected to the light source having the voltage drop higher than that of the reference light source may not be turned on, and the current may not be adjusted. Thus, the luminance between the light sources may not be uniformly distributed, adversely affecting the display quality of the display device.

SUMMARY OF THE INVENTION

Example embodiments of the present invention provide a method of driving a light source capable of equalizing the current levels of light sources.

Example embodiments of the present invention also provide a light source apparatus for performing the method.

Example embodiments of the present invention also provide a display apparatus having the light source apparatus.

According to one aspect of the present invention, a method of driving a light source is provided. Power is provided to a plurality of light source parts connected in parallel. The current level of one of the light source parts is selected as a reference current level. The levels of currents flowing through the light source parts are adjusted to be equal to the reference current level.

In an example embodiment, the current level of the light source part that has a highest total forward voltage may be selected as the reference current. The light source part that has the highest total forward voltage is dynamically reselected such that the light source part that provides the reference current level is not fixed.

In an example embodiment, the levels of currents flowing through the light source parts may be adjusted to be substantially equal to the reference current level by reproducing the currents of the light source parts other than the reference light source part which current level is selected as the reference current level, through a path connected to the reference light source part.

According to another aspect of the present invention, a light source apparatus includes a plurality of light source parts, a power supply part, a current selection part and a current control part. The plurality of the light source parts are connected in parallel and the power supply part provides power to a first terminal of each of the light source parts. The current selection part selects a current level of one of the light source parts as a reference current level. The current control part adjusts the levels of currents flowing through the light source parts to be substantially equal to the reference current level.

In an example embodiment, the current selection part may select the current flowing through the light source part that has a highest total forward voltage as the reference current level. The light source part that has the highest total forward voltage is dynamically reselected such that the light source part that provides the reference current level is not fixed.

In an example embodiment, at least one of the light source parts may include a plurality of light sources connected in series.

In an example embodiment, the light sources may include light emitting diodes.

In an example embodiment, the current selection part may include diodes respectively connected to the light source parts, and each of the diodes may include an anode connected with each to the other diodes and receiving a direct voltage and a cathode connected to a second terminal of one of the light source parts.

In an example embodiment, the current control part may be formed in a current mirror including switching elements respectively connected to the light source parts.

In an example embodiment, each of the switching elements may include an input terminal connected to the second terminal of one of the light source parts and the cathode of one of the diodes, and a control terminal receiving a current at the reference current level.

In an example embodiment, the current selection part may select the level of the current flowing through the light source part connected to the switching element of which the input terminal has minimum lowest voltage among the switching elements as the reference current.

In an example embodiment, the power supply part may provide a constant current to the first terminal of each of the light source parts based on a feedback signal provided form the current control part.

According to still another aspect of the present invention, a display apparatus includes a display panel displaying an image and a light source apparatus disposed under the display panel and providing light to the display panel. The light source apparatus includes a plurality of light source parts, a power supply part, a current selection part and a current control part. The plurality of the light source parts provides light to the display panel and is connected in parallel. The power supply part provides power to a first terminal of each of the light source parts. The current selection part selects a current level of the light source parts to be a reference current level. The current control part adjusts the levels of currents flowing through the light source parts to be substantially equal to the reference current level.

In an example embodiment, the current selection part may select the current level of the light source part that has a highest total forward voltage to be the reference current.

In an example embodiment, at least one of the light source parts may include a plurality of light sources connected in series.

In an example embodiment, the light sources may include light emitting diodes.

In an example embodiment, wherein the light source parts may be disposed facing a rear surface of the display panel.

In an example embodiment, the display apparatus may further include a light guide plate disposed under the display panel and guiding the light to the display panel, and the light source parts may be disposed adjacent to at least one of side surfaces of the light guide plate.

In an example embodiment, the current selection part may include diodes respectively connected to the light source parts, and each of the diodes may include an anode connected to the other diodes and receiving a direct voltage and a cathode connected to a second terminal of one of the light source parts.

In an example embodiment, the current control part may be formed in a current mirror including switching elements respectively connected to the light source parts, and each of the switching elements may include an input terminal connected to the second terminal of one of the light source parts and the cathode of one of the diodes, and a control terminal receiving a current at the reference current level.

According to the present invention, the currents of the light source parts are adjusted based on the current flowing through the light source part having the highest total forward voltage being selected as the reference current, so that the current mirror circuit may be stably driven. This way, luminance between the light sources may be uniformly distributed and display quality of the display apparatus may be improved.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Hereinafter, the present invention will be explained in detail with reference to the accompanying drawings.

Figure 1:
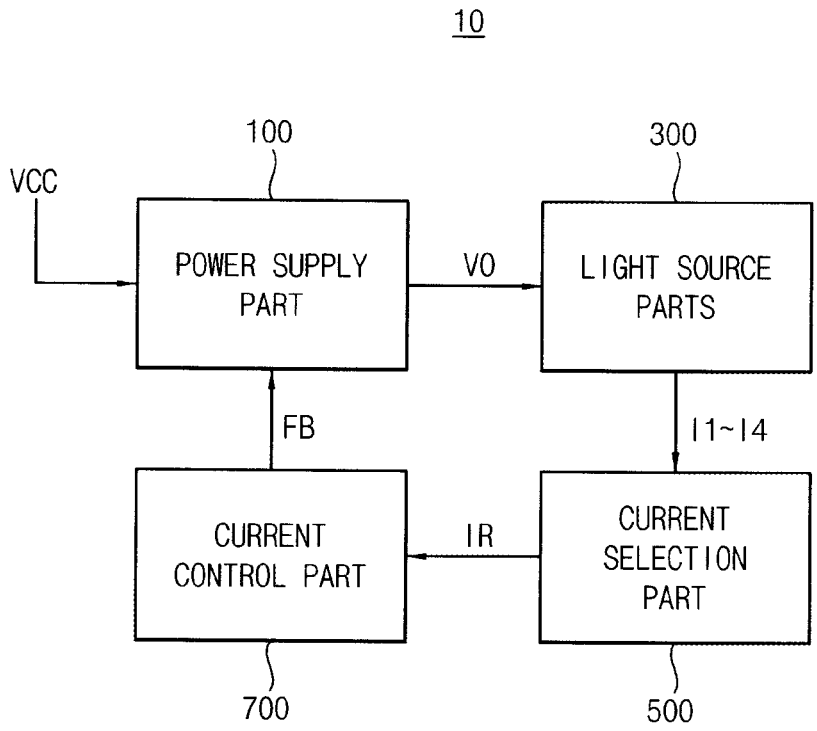
FIG. 1 is a block diagram illustrating a light source apparatus according to an example embodiment of the present invention.
Figure 2:
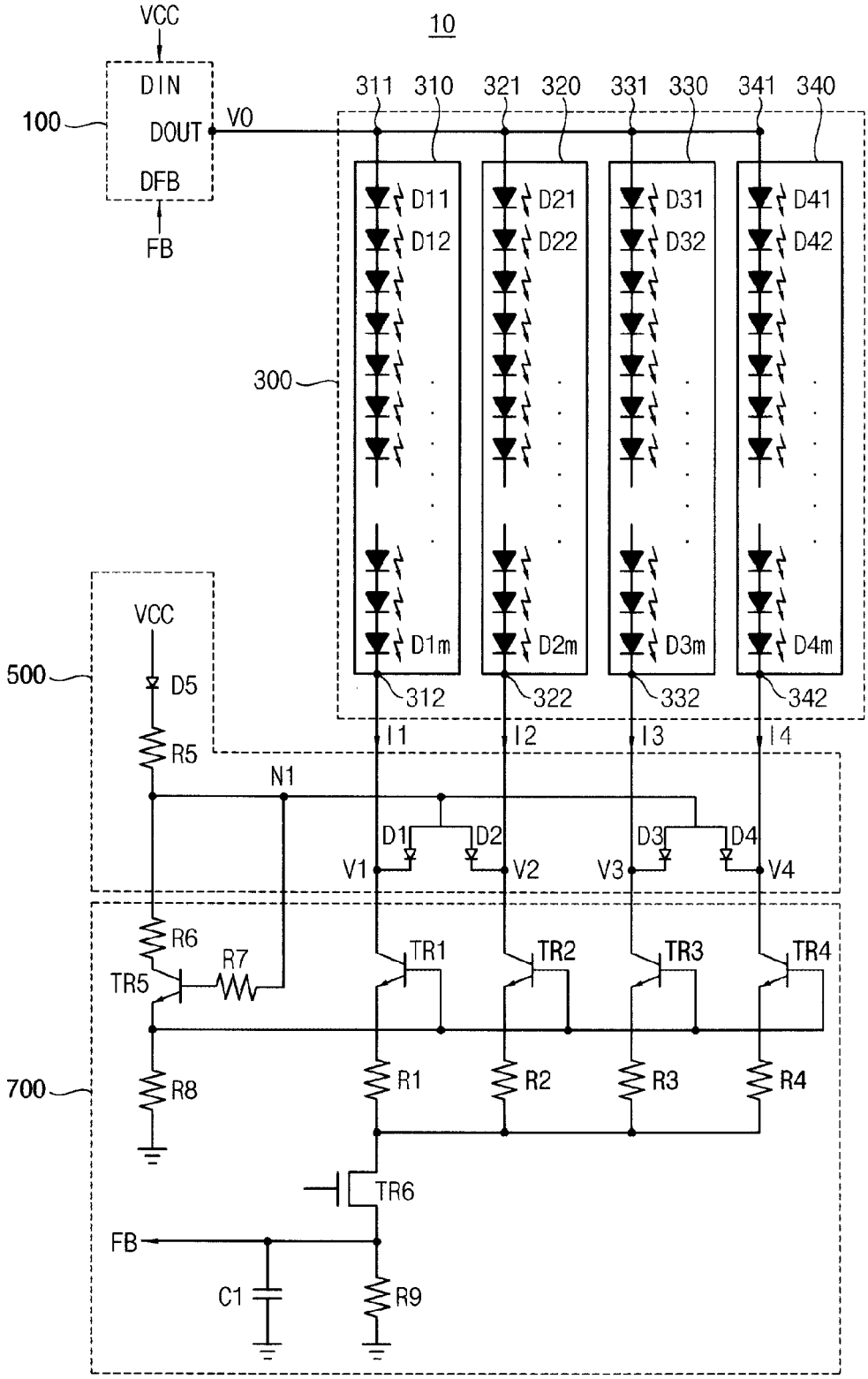
FIG. 2 is a circuit diagram of the light source apparatus of FIG. 1.
Figure 3:
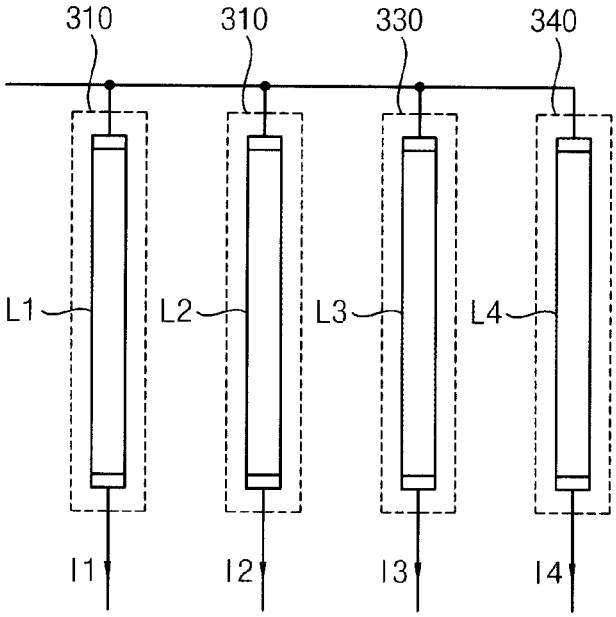
FIGS. 3 and 4 are conceptual diagrams of light source parts of FIG. 1.
Figure 4:
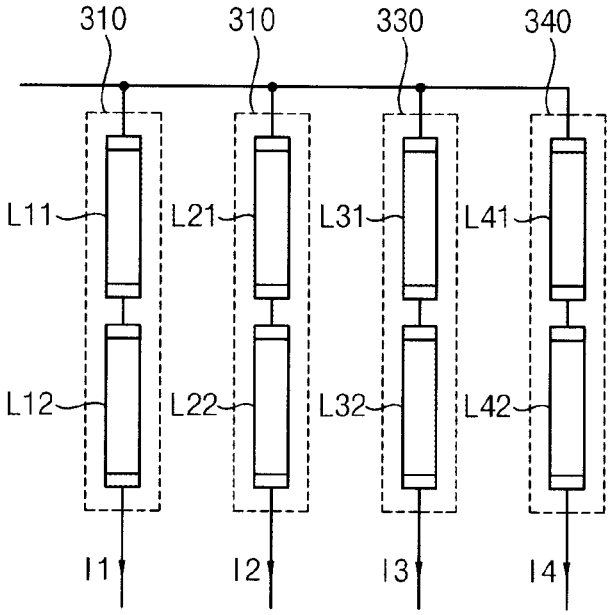
Figure 5:
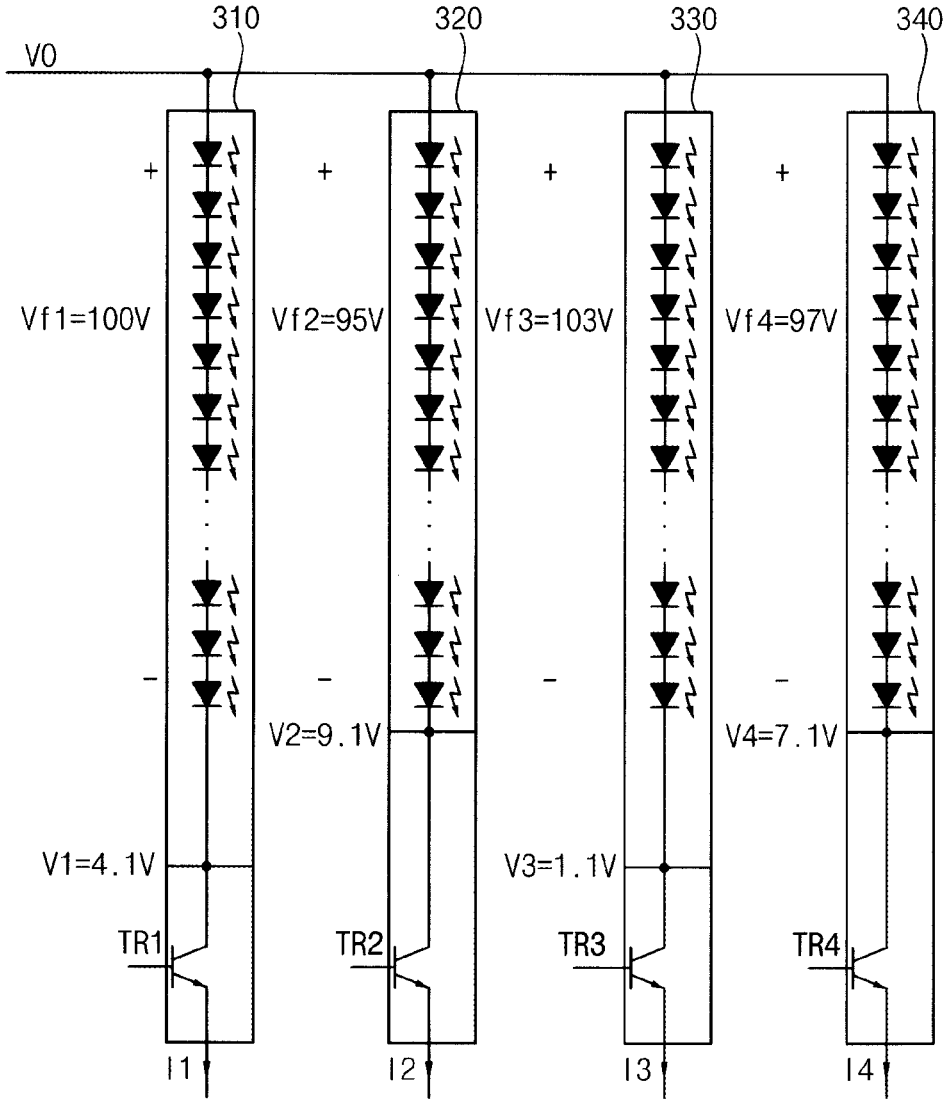
FIG. 5 is a conceptual diagram of total forward voltages of the light source parts of FIG. 2.

FIG. 1 is a block diagram illustrating a light source apparatus according to an example embodiment of the present invention. FIG. 2 is a circuit diagram of the light source apparatus of FIG. 1. FIGS. 3 and 4 are conceptual diagrams of light source parts of FIG. 1. FIG. 5 is a conceptual diagram of total forward voltages of the light source parts of FIG. 2.

Referring to FIGS. 1 to 5, the light source apparatus 10 includes a power supply part 100, light source parts 300, a current selection part 500 and a current control part 700.

The power supply part 100 provides electric power to the light source parts 300. The power supply part 100 receives a direct voltage VCC through an input terminal DIN from outside. The power supply part 100 outputs a constant current through an output terminal DOUT, based on a feedback signal FB provided from the current control part 700 through a feedback terminal DFB.

For example, the feedback signal FB may be a voltage level corresponding to the level of current flowing through the light source parts 300. The power supply part 100 may control the current level outputted to the light source parts 300 based on the difference between the feedback signal FB and a preselected current level. The current level that is output to the light source parts 300 is substantially constant.

The power supply part 100 may include a converter boosting the direct voltage VCC to an output voltage VO for driving the light source parts 300.

The light source parts 300 include more than two light source parts and the light source parts are connected in parallel. In the present example embodiment, the light source parts 300 include four light source parts: a first light source part 310, a second light source part 320, a third light source part 330 and a fourth light source part 340 as shown in FIG. 2.

Each of the first to fourth light source parts 310, 320, 330 and 340 may be a light source or may be a plurality of light sources connected in series. For example, as shown in FIG. 2, each of the first to fourth light source parts 310, 320, 330 and 340 may include a plurality of light emitting diodes connected in series.

The first light source part 310 may include m diodes D11, D12, . . . , D1*m* (m is a natural number) connected in series, the second light source part 320 may include m diodes D21, D22, . . . , D2*m* connected in series, the third light source part 330 may include m diodes D31, D32, . . . , D3*m* connected in series, and the fourth light source part 340 may include m diodes D41, D42, . . . , D4*m* connected in series. Although not shown in figures, each of the first, second, third and fourth light source parts 310, 320, 330 and 340 may include the different number of diodes from one another.

Alternatively, each of the first to fourth light source parts 310, 320, 330 and 340 may include a lamp or a plurality of lamps connected in series.

For example, as shown in FIG. 3, the first light source part 310 may include a first lamp L1, the second light source part 320 may include a second lamp L2, the third light source part 330 may include a third lamp L3, and the fourth light source part 340 may include a fourth lamp L4.

Alternatively, as shown in FIG. 4, the first light source part 310 may include two lamps L11 and L12 connected in series, the second light source part 320 may include two lamps L21 and L22 connected in series, the third light source part 330 may include two lamps L31 and L32 connected in series, and the fourth light source part 340 may include two lamps L41 and L42 connected in series.

The lamp may be a cold cathode fluorescent lamp (CCFL), an external electrode fluorescent lamp (EEFL), a flat fluorescent lamp (FFL), etc.

The first to fourth light source parts 310, 320, 330 and 340 include first terminals 311, 321, 331 and 341 receiving power from the power supply part 100 and second terminals 312, 322, 332 and 342 connected to the current selection part 500 and the current control part 700, respectively. For example, the first terminals 311, 321, 331 and 341 may be anodes of the first to fourth light source parts 310, 320, 330 and 340, respectively. The second terminals 312, 322, 332 and 342 may be cathodes of the first to fourth light source parts 310, 320, 330 and 340, respectively.

When the first to fourth light source parts 310, 320, 330 and 340 generate light by receiving the constant current from the power supply part 100, a voltage drop may occur due to characteristics of the light sources included in the first to fourth light source parts 310, 320, 330 and 340. The difference of the voltage drop may function as an impedance in a circuit of the light source apparatus 10, causing the currents flowing through the first to fourth light source parts 310, 320, 330 and 340 to become different.

In the first to fourth light source parts 310, 320, 330 and 340, the voltage drop from the first terminals 311, 321, 331 and 341 to the second terminals 312, 322, 332 and 342 in a forward direction, respectively, is defined as a total forward voltage.

The total forward voltages of the first to fourth light source parts 310, 320, 330 and 340 are defined as a first total forward voltage Vf1, a second total forward voltage Vf2, a third total forward voltage Vf3 and a fourth total forward voltage Vf4, respectively. Currents flowing through the first to fourth light source parts 310, 320, 330 and 340 in a forward direction are defined as a first current I1, a second current I2, a third current I3 and a fourth current I4.

The first to fourth currents I1, I2, I3 and I4 are not equal due to differences of the first to fourth total forward voltages Vf1, Vf2, Vf3 and Vf4, and luminance of the first to fourth light source parts 310, 320, 330 and 340 are not uniform. Thus, the current control part 700 controls the first to fourth currents I1, I2, I3 and I4 to be equal by reproducing one of the first to fourth currents I1, I2, I3 and I4.

The current selection part 500 selects one of the first to fourth currents I1, I2, I3 and I4 as a reference current for a current reproduced by the current control part 700. The current selection part 500 selects the light source part having a maximum total forward voltage as a reference light source part. For example, the current selection part 500 selects the current flowing through the light source part that has the maximum total forward voltage among the first to fourth total forward voltages Vf1, Vf2, Vf3 and Vf4 as the reference current IR.

The current selection part 500 may be formed in an OR circuit that selects one reference current IR among the first to fourth total forward voltages Vf1, Vf2, Vf3 and Vf4. For example, the current selection part 500 may include first to fourth diodes D1, D2, D3 and D4 connected to the second terminals 312, 322, 332 and 342 of the first to fourth light source parts 310, 320, 330 and 340, respectively.

For example, anodes of the first to fourth diodes D1, D2, D3 and D4 are connected to each other in common and receive the direct voltage VCC. A cathode of the first diode D1 is connected to the second terminal 312 of the first light source part 310, and a cathode of the second diode D2 is connected to the second terminal 322 of the second light source part 320. In the same manner, a cathode of the third diode D3 is connected to the second terminal 332 of the third light source part 330 and a cathode of the fourth diode D4 is connected to the second terminal 342 of the fourth light source part 340.

The direct voltage VCC is provided to the anodes of the first to fourth diodes D1, D2, D3 and D4, and then the direct voltage VCC pulls the first to fourth diodes D1, D2, D3 and D4 up.

The current selection part 500 may further include a fifth diode D5 rectifying the direct voltage VCC and a fifth resistor R5 connected to a cathode of the fifth diode D5 and a common node N1 of the anodes of the first to fourth diodes D1, D2, D3 and D4.

The current control part 700 may be formed in a current mirror circuit for reproducing the first to fourth currents I1, I2, I3 and I4. For example, the current control part 700 may include first to fourth transistors TR1, TR2, TR3 and TR4 respectively connected to the second terminals 312, 322, 332 and 342 of the first to fourth light source parts 310, 320, 330 and 340.

The first to fourth transistors TR1, TR2, TR3 and TR4 may be bipolar transistors and may have same characteristics as one another.

For example, bases of the first to fourth transistors TR1, TR2, TR3 and TR4 may be connected to each other. A collector of the first transistor TR1 may be connected to the second terminal 312 of the first light source part 310 and the cathode of the first diode D1, and an emitter of the first transistor TR1 may be connected to a first terminal of a first resistor R1. In addition, a collector of the second transistor TR2 may be connected to the second terminal 322 of the second light source part 320 and the cathode of the second diode D2, and an emitter of the second transistor TR2 may be connected to a first terminal of a second resistor R2.

In the same manner, a collector of the third transistor TR3 may be connected to the second terminal 332 of the third light source part 330 and the cathode of the third diode D3, and an emitter of the third transistor TR3 may be connected to a first terminal of a third resistor R3. In addition, a collector of the fourth transistor TR4 may be connected to the second terminal 342 of the fourth light source part 340 and the cathode of the fourth diode D4, and an emitter of the fourth transistor TR4 may be connected to a first terminal of a fourth resistor R4.

The current control part 700 may further include a fifth transistor TR5 connected to the common node N1 of the anodes of the first to fourth diodes D1, D2, D3 and D4, a sixth resistor R6 connected to a collector of the fifth transistor TR5, a seventh resistor R7 disposed between the common node N1 of the anodes of the first to fourth diodes D1, D2, D3 and D4 and a base of the fifth transistor TR5, and an eighth resistor R8 disposed between an emitter of the fifth transistor TR5 and a ground.

The fifth transistor TR5 amplifies the voltage between the collector and emitter of each of the first to fourth transistors TR1, TR2, TR3 and TR4, and connects the base of each of the first to fourth transistors TR1, TR2, TR3 and TR4 to a pull-up source so that a current leaked to the base of each of the first to fourth transistors TR1, TR2, TR3 and TR4 is provided through the pull-up source.

The current control part 700 provides the feedback signal FB that is the voltage level corresponding to a sum of the first to fourth currents I1, I2, I3 and I4 to the power supply part 100. To achieve this, the current control part 700 may further include a switching element TR6 having an input terminal connected to a second terminal of each of the first to fourth resistors R1, R2, R3 and R4, a ninth resistor R9 connected to an output terminal of the switching element TR6 and a first capacitor C1.

Hereinafter, a path of selecting the reference current of the current selection part 500 and a process for reproducing the reference current of the current control part 700 will be explained.

As shown in FIG. 5, the output voltage VO provided to the first to fourth light source parts 310, 320, 330 and 340 may be about 104.1 V and the first to fourth total forward voltages Vf1, Vf2, Vf3 and Vf4 may be about 100 V, about 95 V, about 103 V and about 97 V, respectively. In this case, a voltage V1 of the collector of the first transistor TR1 may be about 4.1 V, a voltage V2 of the collector of the second transistor TR2 may be about 9.1 V, a voltage V3 of the collector of the third transistor TR3 may be about 1.1 V and a voltage V4 of the collector of the fourth transistor TR4 may be about 7.1 V.

The third total forward voltage Vf3 has the highest total forward voltage among the first to fourth total forward voltages Vf1, Vf2, Vf3 and Vf4. Hence, the current selection part 500 selects the third light source part 330 as the reference light source part. In one embodiment, the selection of the third light source part 330 entails the third diode D3 connected to the collector of the third transistor TR3 being turned on. The third transistor TR3 has the lowest collector voltage among the first to fourth transistors TR1, TR2, TR3 and TR4.

Therefore, the third current I3 flowing through the third light source part 330 is selected as the reference current. Then, the third current I3 is inputted to the base of each of the first to fourth transistors TR1, TR2, TR3 and TR4 and drives the first to fourth transistors TR1, TR2, TR3 and TR4. The currents flowing through the collectors of the first to fourth transistors TR1, TR2, TR3 and TR4 are made equal to each other, so that the first, second and fourth currents I1, I2 and I4 are finally equal to the third current I3.

A voltage of the common node N1 of the anodes of the first to fourth diodes D1, D2, D3 and D4 is equal to a sum of the lowest collector voltage (here, V3) among the first to fourth transistors TR1, TR2, TR3 and TR4 and a voltage drop across the seventh resistor R7.

In the present invention, the reference light source part that the current control part 700 uses to set the current levels of other light source parts is not fixed, but is dynamically changed according to levels of the total forward voltages of the light source parts 300 by a circuit of the current selection part 500. Thus, any imbalance in controlling the current due to a fixed reference light source part may be solved.

Figure 6:
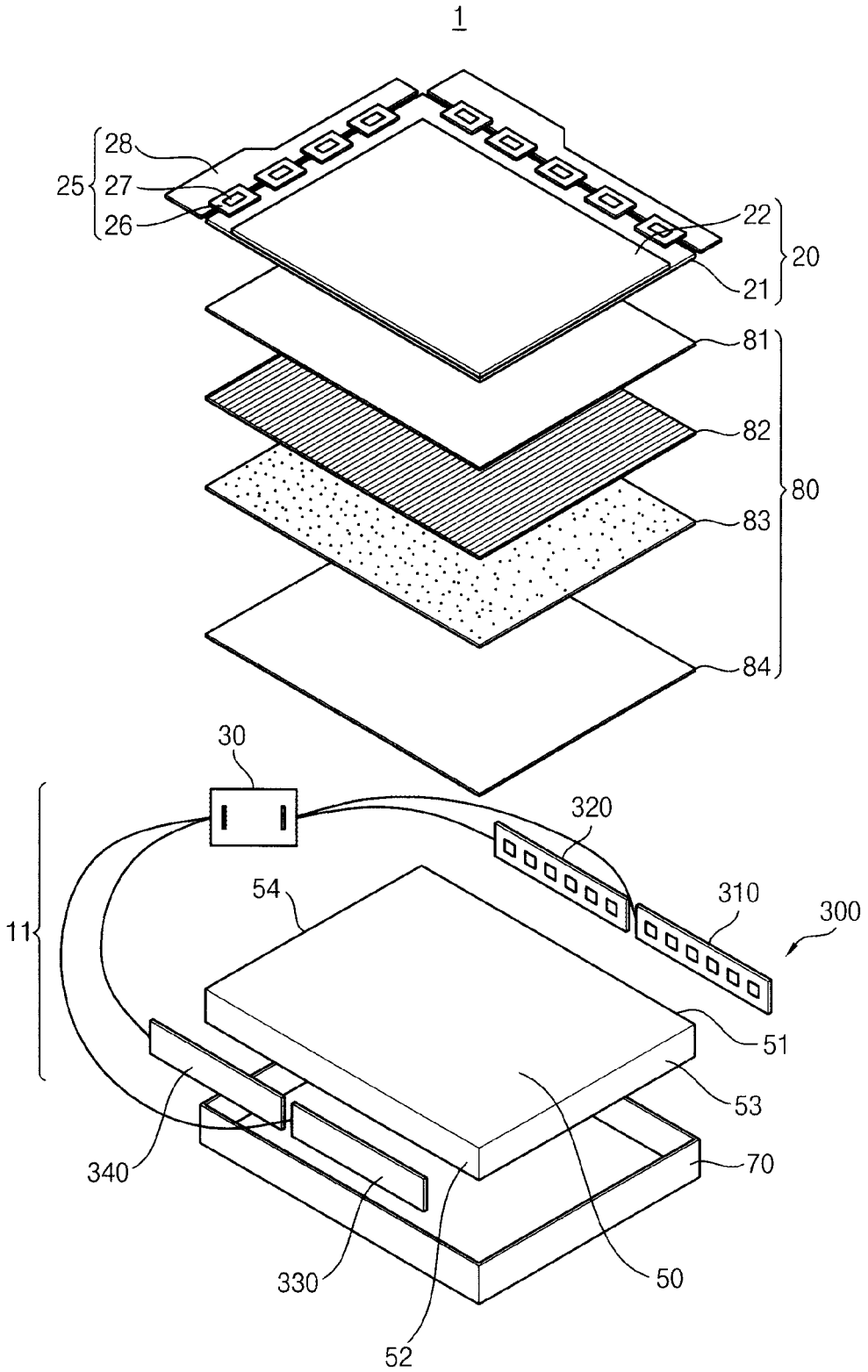
FIG. 6 is an exploded perspective view illustrating a display apparatus having the light source apparatus of FIG. 1.

FIG. 6 is an exploded perspective view illustrating a display apparatus having the light source apparatus of FIG. 1.

Referring to FIG. 6, the display apparatus 1 includes a display panel 20, a light source apparatus 11, a light guide plate 50 and a receiving container 70. The display apparatus 1 may further include a light control part 80 that is disposed between the display panel 20 and the light source apparatus 11 and controls light.

The light source apparatus 11 according to the present example embodiment is substantially the same as the light source apparatus 10 of FIG. 1. Thus, substantially the same elements in FIG. 1 are referred to using the same reference numerals, and further descriptions of substantially the same elements will be omitted. However, the power supply part 100, the current selection part 500 and the current control part 700 in FIG. 1 are integrated and are referred to as a light source driving part 30.

The display panel 20 displays an image. The display panel 20 includes a thin-film transistor substrate 21 having a plurality of thin-film transistors (TFTs) disposed in a matrix arrangement, a color filter substrate 22 facing the thin-film transistor substrate 21 and a liquid crystal layer (not shown) interposed between the thin-film transistor substrate 21 and the color filter substrate 22.

In one embodiment, the display panel 20 may have a rectangular shape. The display panel 20 displays the image by controlling arrangements of liquid crystals, and is a non-emissive display device. Thus, the display panel 20 should be provided with light from the light source parts 300 disposed under the display panel 20.

The thin-film transistor substrate 21 may include a driving part 25 for applying a driving signal. The driving part 25 may include a flexible printed circuit board (FPCB) 26, a driving chip 27 mounted on the FPCB 26, and a printed circuit board (PCB) 28 connected to a first portion of the FPCB 26.

In the present example embodiment, the driving part 25 is formed by a chip on film (COF) method, but may be formed by a tape carrier package (TCP) method, a chip on glass (COG) method, etc. In addition, the driving part 25 may be directly formed on the thin-film transistor substrate 21 in processes for forming lines at the same time.

The light source driving part 80 may include optical sheets such as a protecting sheet 81, a prism sheet 82, a diffusing sheet 83, a reflecting sheet 84 disposed under the display panel 20. This is just one embodiment and a different set of optical sheets that includes other types of optical sheets or omits one or more of the above-mentioned optical sheets may be used.

The protecting sheet 81 protects the prism sheet 82 that is too weak for scratches.

Prisms having a triangle shape may be regularly arranged on an upper surface of the prism sheet 82. The prism sheet 82 concentrates the light diffused by the diffusing sheet 83 on a direction substantially perpendicular to the display panel 20.

Generally, two prism sheets 82 are used, and a micro prism formed on each of the prism sheets 82 is inclined by a predetermined angle. Most of the light passing through the prism sheet 82 may progress substantially perpendicular to the prism sheet 82 and the luminance may be uniformly distributed. A reflecting polarizing film may be used with the prism sheet 82 or may be used without the prism sheet 82 as occasion demands.

The diffusing sheet 83 includes a base substrate, and a coating layer formed on the base substrate and including beads. The diffusing sheet 83 diffuses the light provided from the light source parts 300 to equalize the luminance.

The reflecting sheet 84 reflects the light provided from a lower portion thereof to provide the light to the diffusing sheet 83. The reflecting sheet 84 may include polyethylene terephthalate (PET) or polycarbonate (PC) and may be coated with silver (Ag) or aluminum (Al).

The light guide plate 50 guides the light provided from the light source parts 300. The light guide plate 50 includes a first side surface 51 substantially parallel with the longer side of the display panel 20, a second side surface 52 facing the first side surface 51, a third side surface 53 substantially parallel with the shorter side of the display panel 20, and a fourth side surface 54 facing the third side surface 53. The light guide plate 50 may have a rectangular parallelepiped shape or a wedge shape.

The light source parts 300 may be formed adjacent to at least one of side surfaces of the light guide plate 50. For example, as shown in FIG. 6, the first light source part 310 and the second light source part 320 may be disposed facing the first side surface 51 of the light guide plate 50, and the third light source part 330 and the fourth light source part 340 may be disposed facing the second side surface 52 of the light guide plate 50.

Alternatively, the first light source part 310 and the second light source part 320 may be disposed facing the third side surface 53 of the light guide plate 50, and the third light source part 330 and the fourth light source part 340 may be disposed facing the fourth side surface 54 of the light guide plate 50.

In addition, the light source parts 300 may be disposed facing all the first to fourth side surfaces 51, 52, 53 and 54 of the light guide plate 50 or may be disposed facing only one side surface of the first to fourth side surfaces 51, 52, 53 and 54 of the light guide plate 50.

In addition, each of the light source parts 300 may be a light source or may be a plurality of light sources connected in series. For example, each of the light source parts 300 may include a plurality of light emitting diodes connected in series. Alternatively, each of the light source parts 300 may include a lamp or a plurality of lamps connected in series.

The receiving container 70 receives the display panel 20, the light source parts 300, the light guide plate 50 and the light control part 80. The light source driving part 30 may be positioned on a rear surface of the receiving container 70. The power supply part 100, the current selection part 500 and the current control part 700 are mounted on a single substrate in FIG. 6, but the power supply part 100, the current selection part 500 and the current control part 700 may be mounted on separate substrates, respectively.

In the present example embodiment, the light source driving part 30 drives the light source parts 300 according to the current flowing through the light source part that has the maximum total forward voltage among the light source parts 300, so that luminance of the light source parts 300 disposed adjacent to at least one side surfaces of the light guide plate 50 may be uniformly distributed.

Figure 7:
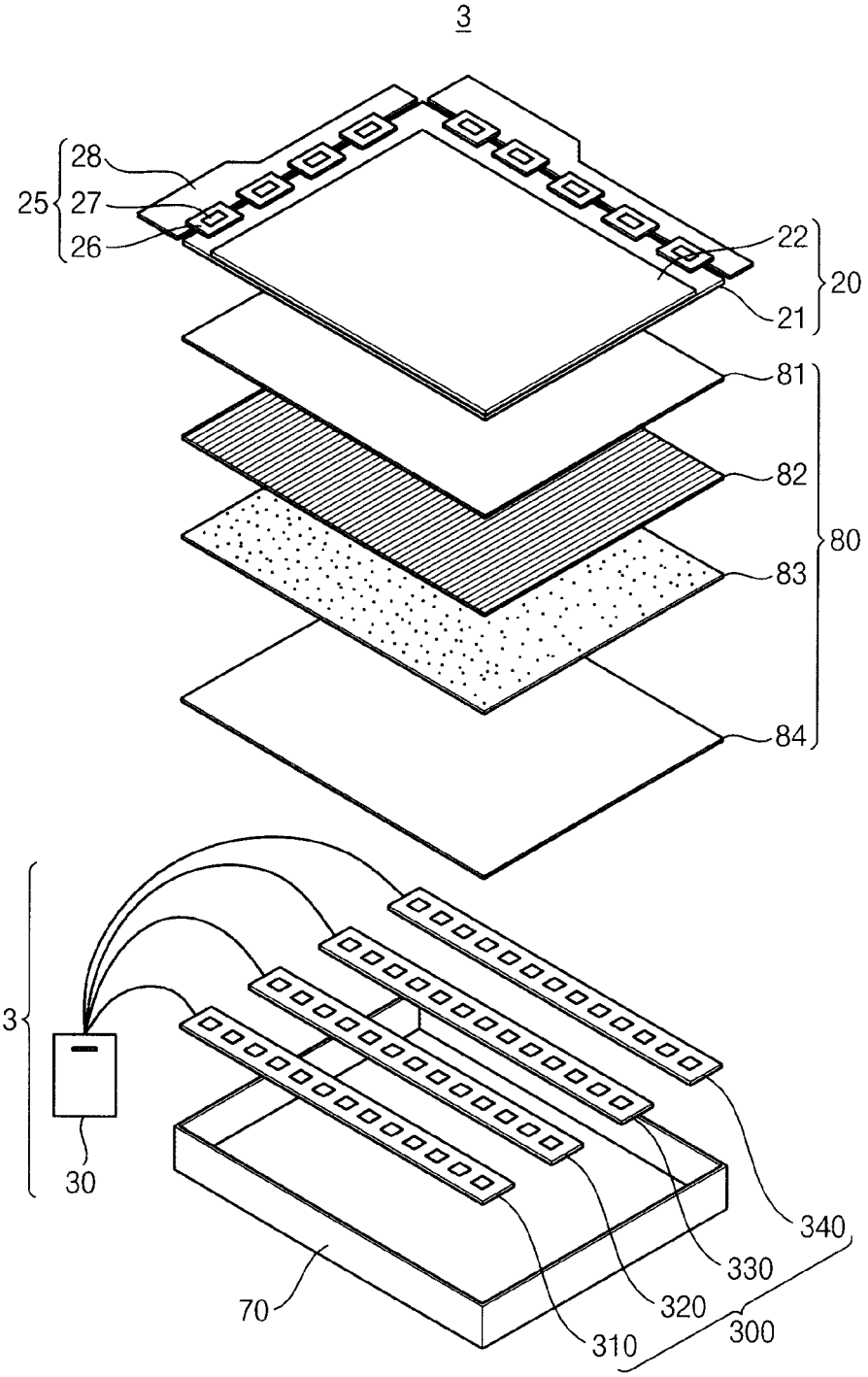
FIG. 7 is an exploded perspective view illustrating a display apparatus having a light source apparatus according to another example embodiment of the present invention.

FIG. 7 is an exploded perspective view illustrating a display apparatus having a light source apparatus according to another example embodiment of the present invention.

Referring to FIG. 7, the display apparatus 3 includes a display panel 20, a light source apparatus 13 and a receiving container 70. The display apparatus 3 may further include a light control part 80 that is disposed between the display panel 20 and the light source apparatus 13 and controls light.

The display apparatus 3 according to the present example embodiment is substantially the same as the display apparatus 1 of FIG. 6, except for a position of the light source parts 300 and an absence of a light guide plate. Thus, substantially the same elements as in FIG. 6 are referred to using the same reference numerals, and further descriptions of substantially the same elements will be omitted.

The light source parts 300 are disposed under the display panel 20. The first to fourth light source parts 310, 320, 330 and 340 may be disposed facing a rear surface of the display panel 20.

Alternatively, the light source parts 300 may include more than two light source parts. In addition, each of the light source parts 300 may be a light source or may be a plurality of light sources connected in series.

For example, each of the light source parts 300 may include a plurality of light emitting diodes connected in series. Alternatively, each of the light source parts 300 may include a lamp or a plurality of lamps connected in series.

In the present example embodiment, the light source driving part 30 drives the light source parts 300 according to the current flowing through the light source part that has the maximum total forward voltage among the light source parts 300, so that the luminance of the light source parts 300 disposed under the display panel 20 may be uniformly distributed.

As described above, according to the present invention, the current flowing through the light source part having the highest total forward voltage among the light source parts is selected as the reference current and is reproduced, so that the current of the light source parts may be stably controlled. Thus, the luminance between the light sources may be uniformly distributed and display quality of the display apparatus may be improved.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method of driving a light source, the method comprising:

providing power to a plurality of light source parts connected in parallel such that levels of current flow through the light source parts;

determining that a first light source part has a highest total forward voltage among the plurality of light source parts;

selecting a reference current level to be a current level of the first light source part;

adjusting the levels of currents flowing through the light source parts to be substantially equal to the reference current level;

determining that the first light source part no longer has the highest total forward voltage and that a second light source part has the highest total forward voltage among the plurality of light source parts; and updating the reference current level to be a current level of the second light source part; and re-adjusting the levels of currents flowing through the light source parts to be substantially equal to the updated reference current level.

2. A method of driving a light source, the method comprising:

providing power to a plurality of light source parts connected in parallel;

selecting a current level of one of the light source parts to be a reference current level; and adjusting the levels of currents flowing through the light source parts to be substantially equal to the reference current level, wherein adjusting the level of currents flowing through the light source parts comprises:

reproducing the currents for light source parts other than a reference light source part which current level is selected as the reference current level, through a path connected to the reference light source part.

3. A light source apparatus comprising:

a plurality of light source parts connected in parallel such that levels of current flow through the light source parts;

a power supply part providing power to a first terminal of each of the light source parts;

a current selection part determining that a first light source part has a highest total forward voltage among the plurality of light source parts and selecting a reference current level to be a current level of the first light source part; and a current control part adjusting the levels of currents flowing through the light source parts to be substantially equal to the reference current level, wherein the current selection part further determines that the first light source part no longer has the highest total forward voltage and that a second light source part has the highest total forward voltage among the plurality of light source parts and updates the reference current level to be a current level of the second light source part, and the current control part further re-adjusts the levels of currents flowing through the light source parts to be substantially equal to the updated reference current level.

4. The light source apparatus of claim 3, wherein at least one of the light source parts comprises a plurality of light sources connected in series.

5. The light source apparatus of claim 4, wherein the light sources comprise light emitting diodes.

6. A light source apparatus comprising:

a plurality of light source parts connected in parallel;

a power supply part providing power to a first terminal of each of the light source parts;

a current selection part selecting a current level of one of the light source parts to be a reference current level; and a current control part adjusting the levels of currents flowing through the light source parts to be substantially equal to the reference current level, wherein the current selection part comprises diodes respectively connected to the light source parts, and each of the diodes comprises an anode that is connected to the other diodes and receives a direct voltage and a cathode that is connected to a second terminal of one of the light source parts.

7. The light source apparatus of claim 6, wherein the current control part is formed in a current mirror including switching elements respectively connected to the light source parts.

8. The light source apparatus of claim 7, wherein each of the switching elements comprises:

an input terminal connected to the second terminal of one of the light source parts and the cathode of one of the diodes; and a control terminal receiving a current at the reference current level.

9. The light source apparatus of claim 8, wherein the current selection part selects the level of the current flowing through the light source part connected to the switching element of which the input terminal has a lowest voltage among the switching elements as the reference current level.

10. The light source apparatus of claim 6, wherein the power supply part provides a constant current to the first terminal of each of the light source parts based on a feedback signal provided from the current control part.

11. A display apparatus comprising:

a display panel displaying an image; and a light source apparatus disposed under the display panel and providing light to the display panel, the light source apparatus comprising:

a plurality of light source parts providing light to the display panel and connected in parallel;

a power supply part providing power to a first terminal of each of the light source parts parallel such that levels of current flow through the light source parts;

a current selection part determining that a first light source part has a highest total forward voltage among the plurality of light source parts and selecting a reference current level to be a current level of the first light source part; and a current control part adjusting the levels of currents flowing through the light source parts to be substantially equal to the reference current level, wherein the current selection part further determines that the first light source part no longer has the highest total forward voltage and that a second light source part has the highest total forward voltage among the plurality of light source parts and updates the reference current level to be a current level of the second light source part, and the current control part further re-adjusts the levels of currents flowing through the light source parts to be substantially equal to the updated reference current level.

12. The display apparatus of claim 11, wherein at least one of the light source parts comprises a plurality of light sources connected in series.

13. The display apparatus of claim 12, wherein the light sources comprise light emitting diodes.

14. The display apparatus of claim 11, wherein the light source parts are disposed facing a rear surface of the display panel.

15. The display apparatus of claim 11, wherein the current selection part comprises diodes respectively connected to the light source parts, and each of the diodes comprises an anode connected to the other diodes and receiving a direct voltage and a cathode connected to a second terminal of one of the light source parts.

16. The display apparatus of claim 15, wherein the current control part is formed in a current mirror including switching elements respectively connected to the light source parts, and each of the switching elements comprises:

an input terminal connected to the second terminal of one of the light source parts and the cathode of one of the diodes; and a control terminal receiving a current at the reference current level.

17. A display apparatus comprising:

a display panel displaying an image;

a light source apparatus disposed under the display panel and providing light to the display panel, the light source apparatus comprising:

a plurality of light source parts providing light to the display panel and connected in parallel, a power supply part providing power to a first terminal of each of the light source parts parallel, a current selection part selecting a current level of one of the light source parts to be a reference current level, and a current control part adjusting the levels of currents flowing through the light source parts to be substantially equal to the reference current level; and a light guide plate disposed under the display panel and guiding the light to the display panel, wherein the light source parts are disposed adjacent to at least one of side surfaces of the light guide plate.

* * * * *